US008991106B2

(12) United States Patent
Mora

(10) Patent No.: US 8,991,106 B2
(45) Date of Patent: Mar. 31, 2015

(54) ROOF PANEL SPACER

(71) Applicant: Formula Plastics, Inc., Tecate, CA (US)

(72) Inventor: Elias Mora, Chula Vista, CA (US)

(73) Assignee: Formula Plastics, Inc., Tecate, CA (US)

( * ) Notice: Subject to any disclaimer, the term of this patent is extended or adjusted under 35 U.S.C. 154(b) by 0 days.

(21) Appl. No.: 14/037,170

(22) Filed: Sep. 25, 2013

(65) Prior Publication Data

US 2014/0020309 A1 Jan. 23, 2014

Related U.S. Application Data

(62) Division of application No. 13/168,089, filed on Jun. 24, 2011, now Pat. No. 8,544,239.

(60) Provisional application No. 61/398,461, filed on Jun. 25, 2010.

(51) Int. Cl.
*E04D 12/00* (2006.01)
*E04D 13/17* (2006.01)

(52) U.S. Cl.
CPC ..... *E04D 12/00* (2013.01); *E04D 13/17* (2013.01)
USPC ..... 52/93.1; 52/302.3; 52/302.1; 52/551

(58) Field of Classification Search
CPC .... E04F 13/0864; E04F 13/0803; E04D 1/34; E04D 13/17; E04D 12/00; E04D 12/004
USPC ..... 52/90.1, 93.1, 302.1, 302.3, 478, 551, 52/DIG. 17
See application file for complete search history.

(56) References Cited

U.S. PATENT DOCUMENTS

| | | | | | |
|---|---|---|---|---|---|
| 3,797,179 | A | * | 3/1974 | Jackson | 52/90.1 |
| 4,355,491 | A | * | 10/1982 | Martin et al. | 52/540 |
| 5,056,288 | A | * | 10/1991 | Funaki | 52/545 |
| 5,249,402 | A | * | 10/1993 | Crick et al. | 52/533 |
| 5,390,453 | A | | 2/1995 | Untiedt | |
| 6,061,973 | A | * | 5/2000 | Accardi et al. | 52/90.1 |
| 6,948,288 | B1 | * | 9/2005 | Smith | 52/409 |
| 8,544,239 | B2 | | 10/2013 | Mora | |

(Continued)

FOREIGN PATENT DOCUMENTS

| | | | | |
|---|---|---|---|---|
| EP | 2042664 | | 4/2009 | |
| GB | 2181470 | * | 4/1987 | E04D 13/16 |

OTHER PUBLICATIONS

International Search Report and Written Opinion for PCT Application No. PCT/US11/41874, dated Nov. 18, 2011.

(Continued)

*Primary Examiner* — Brian Glessner
*Assistant Examiner* — Adam Barlow
(74) *Attorney, Agent, or Firm* — Knobbe Martens Olson & Bear LLP

(57) ABSTRACT

Devices, methods, and systems are provided herein for spacing an outer skin of a roof from the supporting structure of the roof such that the roof shields against weather elements, admits light, and allows advantageous air circulation. In one embodiment, a wedge-shaped device for spacing panels on a roof includes a bottom surface, a top surface inclined at an angle relative to the bottom surface, and an integral support structure connecting the top surface and the bottom surface, the support structure including a plurality of ribs and a plurality of nail boxes.

20 Claims, 13 Drawing Sheets

(56) References Cited

U.S. PATENT DOCUMENTS

| | | | | |
|---|---|---|---|---|
| 2003/0182888 | A1* | 10/2003 | Desbois et al. | 52/551 |
| 2006/0150536 | A1 | 7/2006 | Smith | |
| 2008/0209822 | A1* | 9/2008 | Rosten et al. | 52/90.1 |
| 2010/0031593 | A1 | 2/2010 | Klose | |
| 2010/0313491 | A1* | 12/2010 | Austin et al. | 52/95 |
| 2011/0113704 | A1* | 5/2011 | Lenox | 52/173.3 |

OTHER PUBLICATIONS

Office Action dated Dec. 21, 2012 issued in U.S. Appl. No. 13/168,089.

* cited by examiner

ROOF PANEL SPACER

CROSS-REFERENCE TO RELATED APPLICATIONS

The present application is a divisional of U.S. patent application Ser. No. 13/168,089, filed Jun. 24, 2011, which claims priority under 35 U.S.C. §119(e) to U.S. Provisional Patent Application Ser. No. 61/398,461, filed on Jun. 25, 2010. The disclosures of all of the above-referenced prior applications, publications, and patents are considered part of the disclosure of this application, and are incorporated by reference herein in their entirety.

BACKGROUND

1. Field of the Invention

The field of the invention relates to roofing materials, and more particularly to methods and systems for spacing panels on roofs.

2. Description of the Related Art

Roofs cover the uppermost part of a space or building, protecting the space or building interior from rain, snow, wind, cold, heat, sunlight, and other weather effects. Many roofs are pitched or sloped to provide additional protection against the weather, allowing rain or snow to run off the angled sides of the roof. Roofs generally include a supporting structure and an outer skin, which can be an uppermost weatherproof layer. The supporting structure of a roof typically includes beams of a strong, rigid material such as timber, cast iron, or steel. The outer layer of a roof can comprise panels or boards constructed of timber, metal, plastic, vegetation such as bamboo stems, or other suitable materials.

In some cases, a pitched roof is desired to shield a space against elements such as rain or snow, while still admitting light into the space and allowing air to freely circulate through the roof and into the space. Thus, methods and systems to efficiently and reliably attach an outer skin to the supporting structure of a roof such that the roof shields against weather elements, admits light, and allows advantageous air circulation are desired and remain a significant challenge in the design of roofing systems.

SUMMARY OF CERTAIN EMBODIMENTS

The systems, methods, and devices of the invention each have several aspects, no single one of which is solely responsible for its desirable attributes. Without limiting the scope of this invention, its more prominent features will now be discussed briefly. After considering this discussion, and particularly after reading the section entitled "Detailed Description" one will understand how the features of this invention provide advantages over other roofing systems.

Methods and devices for spacing panels on a roof are provided. In one embodiment, a wedge-shaped device for spacing panels on a roof includes a bottom surface; a top surface inclined at an angle $\alpha$ relative to the bottom surface; and an integral support structure connecting the top surface and the bottom surface. The support structure includes a plurality of support ribs and a plurality of nail boxes.

Another embodiment provides a method of installing roof panels on roof support beams. The method includes fastening a plurality of wedge-shaped spacers to a top surface of one or more roof support beams; and fastening a bottom surface of one or more roof panels to the spacers.

In yet another embodiment, a roof panel spacer system for constructing a roof is provided. The system includes a plurality of support beams; a plurality of spacers fastened to at least some of said support beams; and a plurality of roof panels fastened to the plurality of spacers. Each spacer orients each roof panel substantially horizontal to the ground. Each spacer is positioned to create a space between adjacent roof panels allowing air and light to pass through the roof. Each spacer is also positioned to create an overlap between adjacent roof panels, inhibiting rain and other weather elements from passing through the roof.

DETAILED DESCRIPTION

Any feature or combination of features described herein are included within the scope of the present invention provided that the features included in any such combination are not mutually inconsistent as will be apparent from the context, this description, and the knowledge of one skilled in the art. In addition, any feature or combination of features may be specifically excluded from any embodiment of the present invention. For purposes of summarizing the present invention, certain aspects, advantages, and novel features of the present invention are described herein. Of course, it is to be understood that not necessarily all such aspects, advantages, or features will be present in any particular embodiment of the present invention.

It is to be understood that embodiments presented herein are by way of example and not by way of limitation. The intent of the following detailed description, although discussing exemplary embodiments, is to be construed to cover all modifications, alternatives, and equivalents of the embodiments as may fall within the spirit and scope of the invention.

Roof Panel Spacer for Two-Sided Roof

Figure 1A:
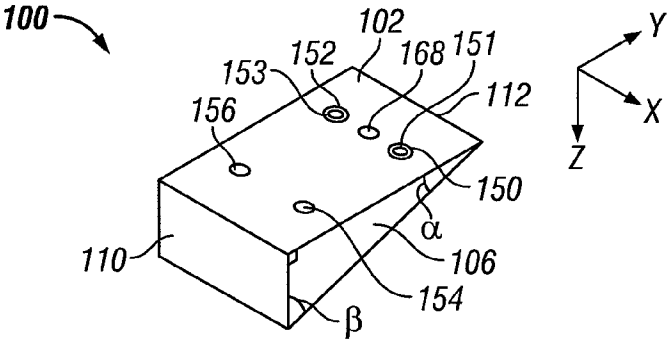
FIG. 1A is a top perspective view of an embodiment of a roof panel spacer device.
Figure 1B:
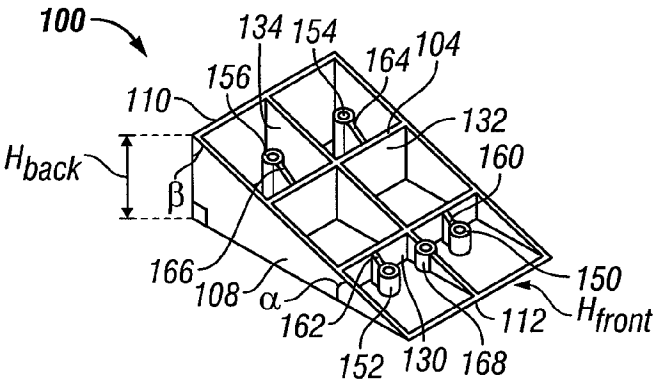
FIG. 1B is a bottom perspective view of the device of FIG. 1A.
Figure 1C:
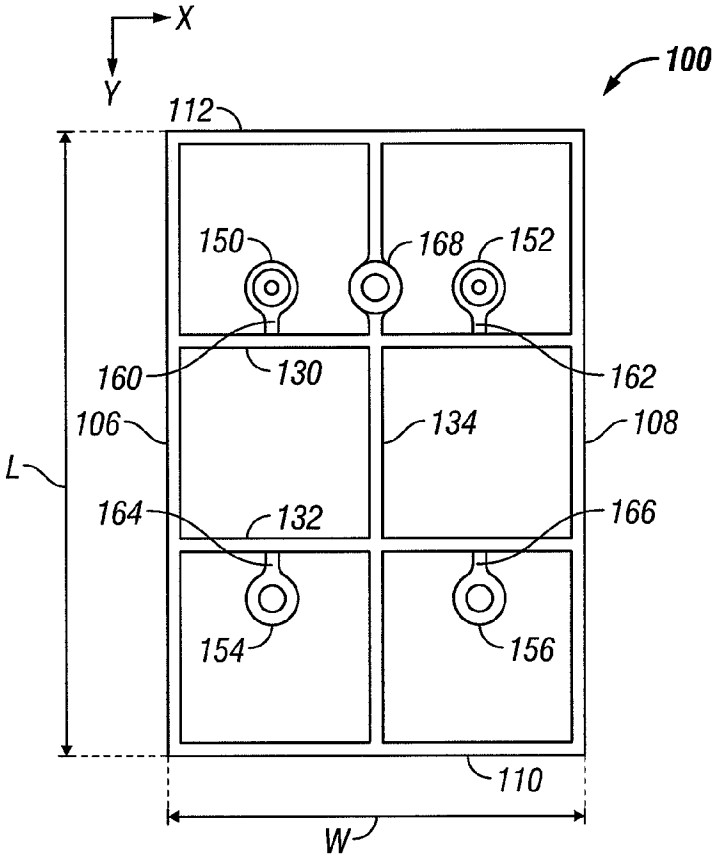
FIG. 1C is a bottom elevational view of the device of FIG. 1A.

FIG. 1A is a top perspective view of an embodiment of a roof panel spacer 100 according to the present invention. FIG. 1B is a bottom perspective view of the spacer 100. FIG. 1C is a bottom elevational view of the spacer 100. The spacer 100 generally has a width W measured along an x-axis of the spacer 100, a length L measured along a y-axis of the spacer 100, and a height H measured along a z-axis of the spacer 100.

The spacer 100 includes a top surface 102; a bottom surface 104; sides 106, 108; a back 110; and a front 112.

The height H of the spacer 100 can be measured at different locations along the spacer 100. For example, the height of the spacer 100 at the back 110 can be $H_{BACK}$, while the height of the spacer 100 at the front 112 can be $H_{FRONT}$. Embodiments of the spacer 100 can be wedge-shaped. For example, the top surface 102 can be inclined at an angle $\alpha$ relative to the bottom surface 104. Additionally, the bottom surface 104 can be inclined at an angle $\beta$ relative to the back 110. In some aspects, the top surface 102 is oriented at an angle of 90° or about 90° relative to the back 110.

The spacer 100 can include an integral support structure connecting the top surface 102 and the bottom surface 104. The support structure can include a plurality of support ribs. For example, the spacer 100 includes width ribs 130, 132 extending along the width W of the spacer 100 between the sides 106, 108. The spacer 100 can also comprise a length rib 134 extending along the length L of the spacer 100 between the back 110 and the front 112. Bottom surfaces of the ribs 130, 132, 134 can form all or a portion of the bottom surface 104 of the spacer 100.

In some aspects, the support structure also includes a plurality of nail boxes. For example, the spacer 100 includes nail boxes 150, 152, 154, 156, which will be described in greater detail below with reference to FIGS. 8-10B. The nail boxes can be configured to accept nails or other fasteners. Some embodiments of the nail boxes 150, 152, 154, 156 comprise a hollow tube extending from the top surface 102 and the bottom surface 104. The nail boxes can be connected to the width ribs 130, 132 via flanges 160, 162, 164, 166, respectively. The spacer 100 may also comprise a nail box 168 disposed in the length rib 134. Other configurations are possible. For example, in some aspects, the spacer 100 may not comprise one or more of width ribs, length ribs, nail boxes, and/or flanges.

Figure 2:
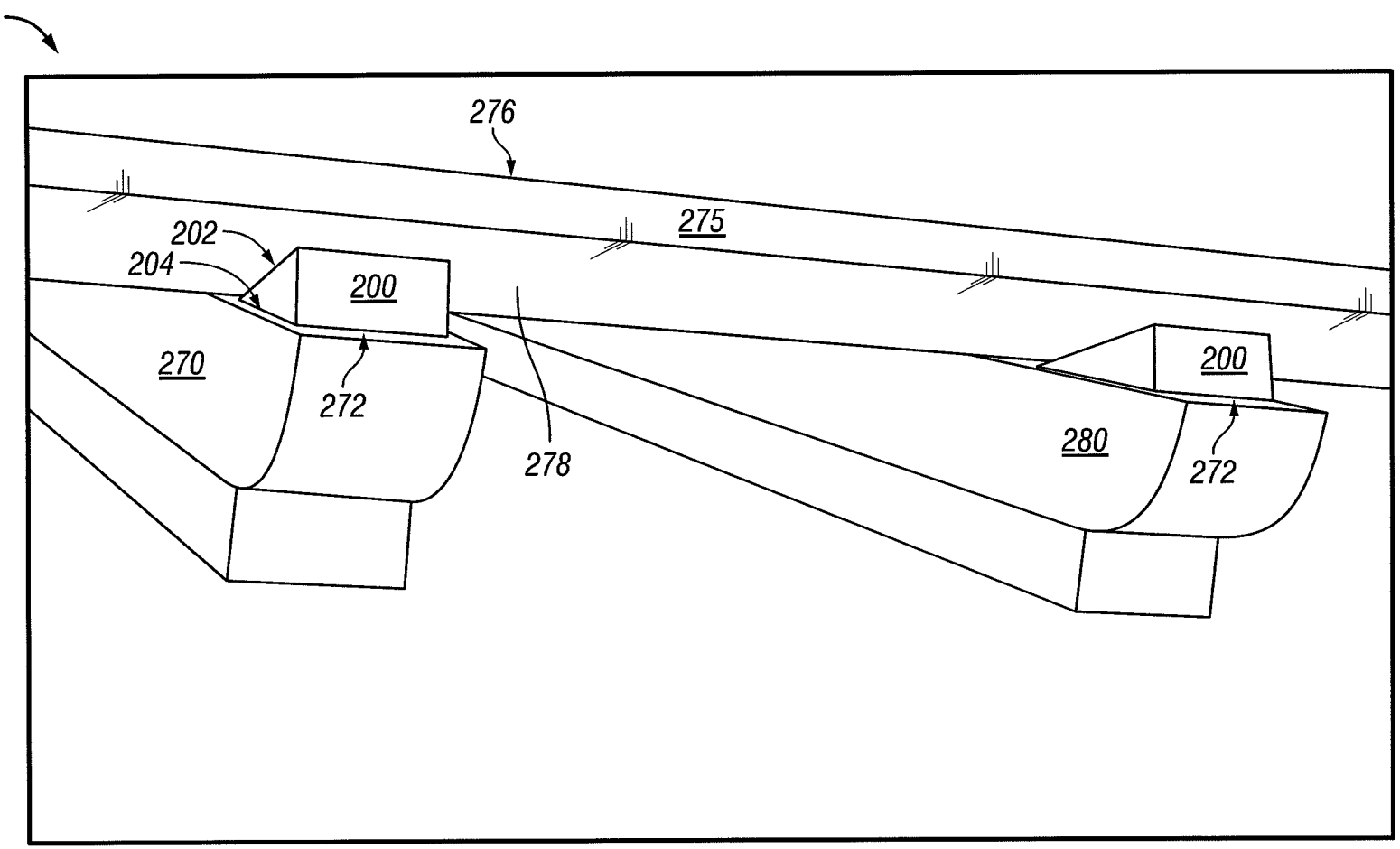
FIGS. 2-7 illustrate the device of FIG. 1A in use on a roof.

FIGS. 2-7 illustrate one embodiment of a spacer according to the present invention in use on a roof 268. Referring now to FIG. 2, a first spacer 200 according to one embodiment is positioned between a first support beam 270 and a roofing panel or board 275. The support beam 270 includes a top surface 272. The panel 275 comprises a top surface 276 and a bottom surface 278. A second spacer 200 is also positioned between a second support beam 280 and the panel 275. The support beams 270, 280 can comprise portions of the support structure of a roofing system, and the panel 275 can comprise a portion of the outer skin of the roofing system.

A top surface 202 of the spacers 200 are adjacent to and contact the bottom surface 278 of the panel 275, while a bottom surface 204 of the spacers 200 are adjacent to and contact the top surfaces 272 of the support beams 270, 280. Other configurations are possible. For example, in another embodiment, the top surface 202 of the spacers 200 may be adjacent to the support beams 270, 280 and the bottom surface 204 of the spacers 200 may be adjacent to the panel 275.

Figure 3:
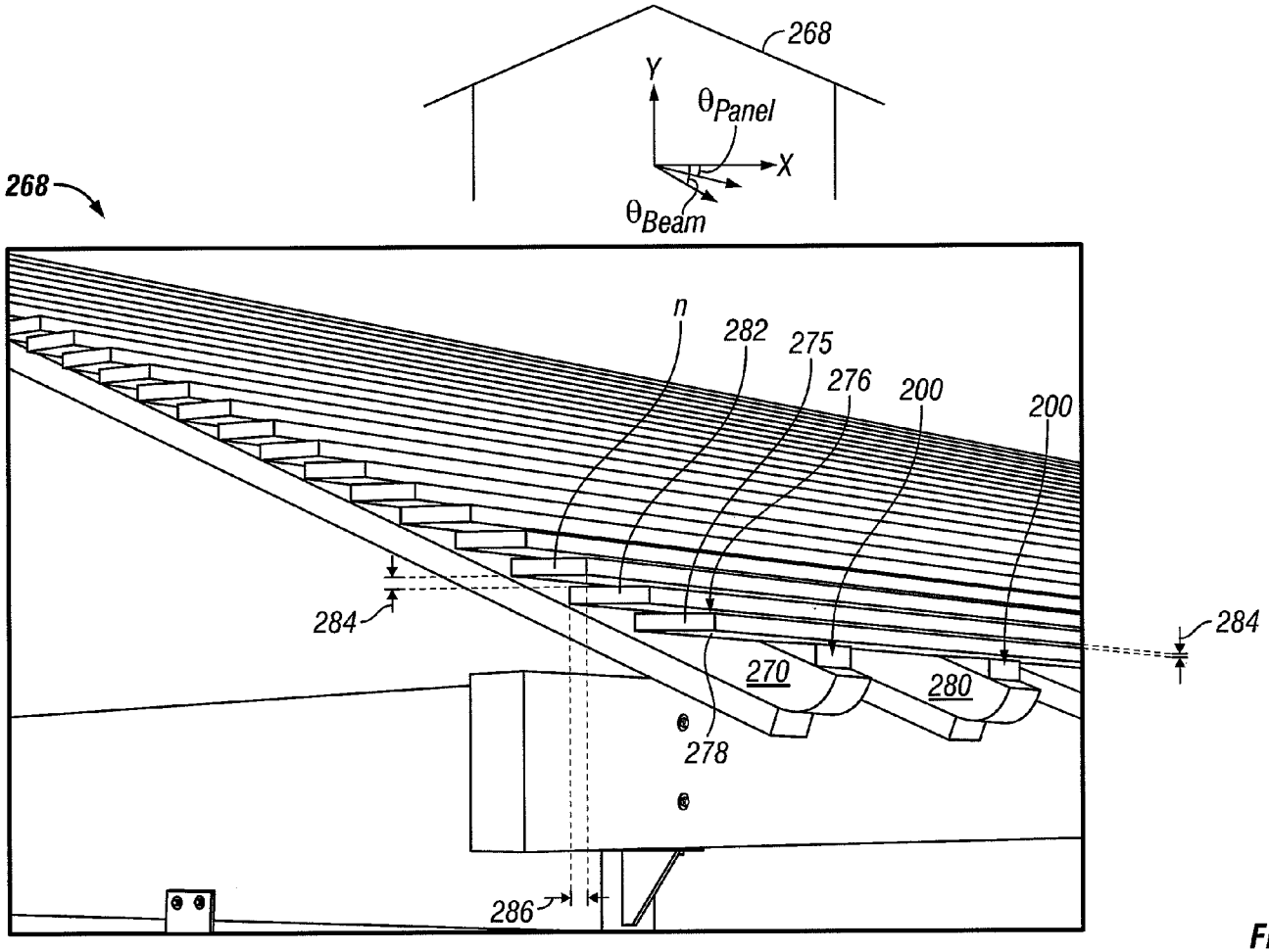
Figure 4:
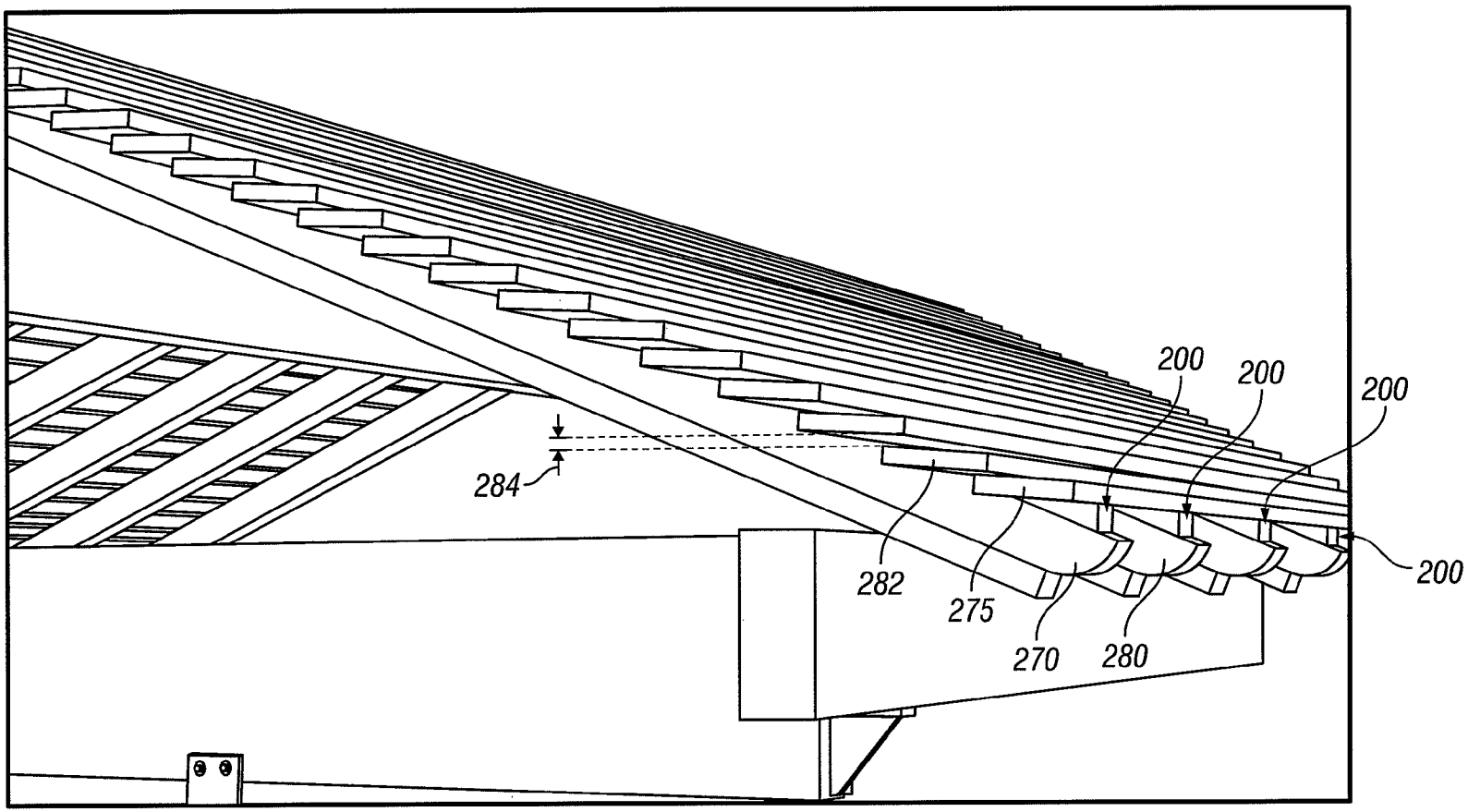

FIGS. 3 and 4 illustrate embodiments of the spacers 200 in use. The support beams 270, 280 are inclined relative to a horizontal axis x of the roof 268 by an angle $\theta_{BEAM}$. The panel 275 is inclined relative to the horizontal axis x of the roof 268 by an angle $\theta_{PANEL}$. As described above, the spacers 200 are positioned between the panel 275 and the support beams 270, 280. Additional spacers 200 (not illustrated in FIGS. 3 and 4, but illustrated in FIG. 5) are positioned between a panel 282 and the support beams 270, 280. An "n" number of panels can be positioned on the support beams 270, 280 using the spacers 200. Additionally, the panels 275, 282 can be positioned on "n" number of support beams using the spacers 200 in order to construct the roof 268.

In some embodiments, the spacers 200 are positioned on the support beams 270, 280 such that the panels 275, 282 are horizontal or substantially horizontal to the ground and $\theta_{PANEL}$ is 0° or about 0°. The spacers 200 may be positioned on the support beams 270, 280 such that a vertical space 284 separates the panels 275, 282. In the embodiment illustrated in FIG. 3, for example, each of the adjacent panels on the roof 268 are separated by the vertical space 284. The spacers 200 can be positioned along the support beam 270 at the same or substantially the same distance intervals, such that the vertical spaces 284 separating adjacent panels are the same or substantially the same. It will be understood, however, that the vertical space 284 separating adjacent panels of the roof 268 need not be the same or substantially the same across the entire roof 268. The vertical spaces 284 can advantageously allow for air to enter the space underneath the roof 268 and circulate within the space. Advantageously, the vertical spaces 284 can also allow light to enter the space underneath the roof 268.

In some aspects, the top surface 276 of the panel 275 and the bottom surface 278 of the panel 282 overlap in a region 286. This overlap between adjacent panels 275, 282 can advantageously restrict rain and other weather elements from passing through the vertical space 284 and entering the space underneath the roof 268. For example, embodiments of spacers described herein can shield the interior of a building or other space below a roof from light rain and/or rain without horizontal wind.

Persons of skill in the art will understand that the spacers 200 can be used with roofs 268 of varying slope or pitch. For example, the support beams 270, 280 may be less sloped relative to the horizontal axis x of the roof 268 (corresponding to a smaller beam angle $\theta_{BEAM}$ than that illustrated in FIGS. 2-7), in which case the angle $\alpha$ of the spacer 200 may be decreased. Similarly, the support beams 270, 280 may be more sloped relative to the horizontal axis x of the roof 268 (corresponding to a greater beam angle $\theta_{BEAM}$ than that illustrated in FIGS. 2-7). In such cases, the angle $\alpha$ of the spacer 200 can be increased accordingly. Of course, it will be understood that beam angle $\theta_{BEAM}$ may not be equal to the angle $\alpha$ of the spacer 200.

Figure 5:
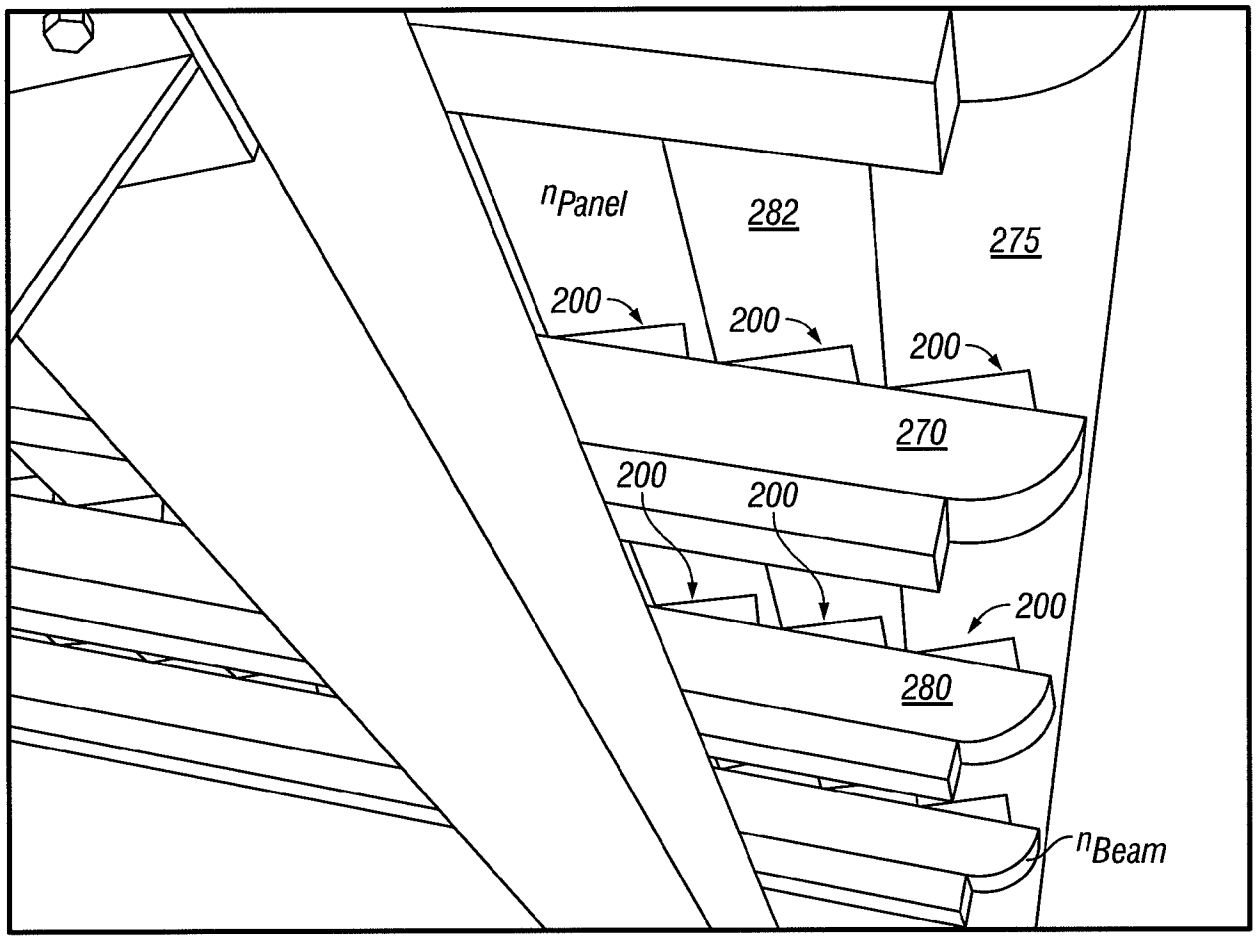

FIG. 5 illustrates a plurality of spacers 200 in use on adjacent panels 275, 282. For example, the panel 275 is spaced from the support beam 270 by a first spacer 200, from the support beam 280 by a second spacer 200, and from a support beam $n_{BEAM}$ by a third spacer 200. The panel 282 is spaced from the support beam 270 by a fourth spacer 200, from the support beam 280 by a fifth spacer 200, and from the support beam $n_{BEAM}$ by a sixth spacer 200. Each of the panels of the roof 268 can be spaced from the support beams in a similar manner.

Figure 6:
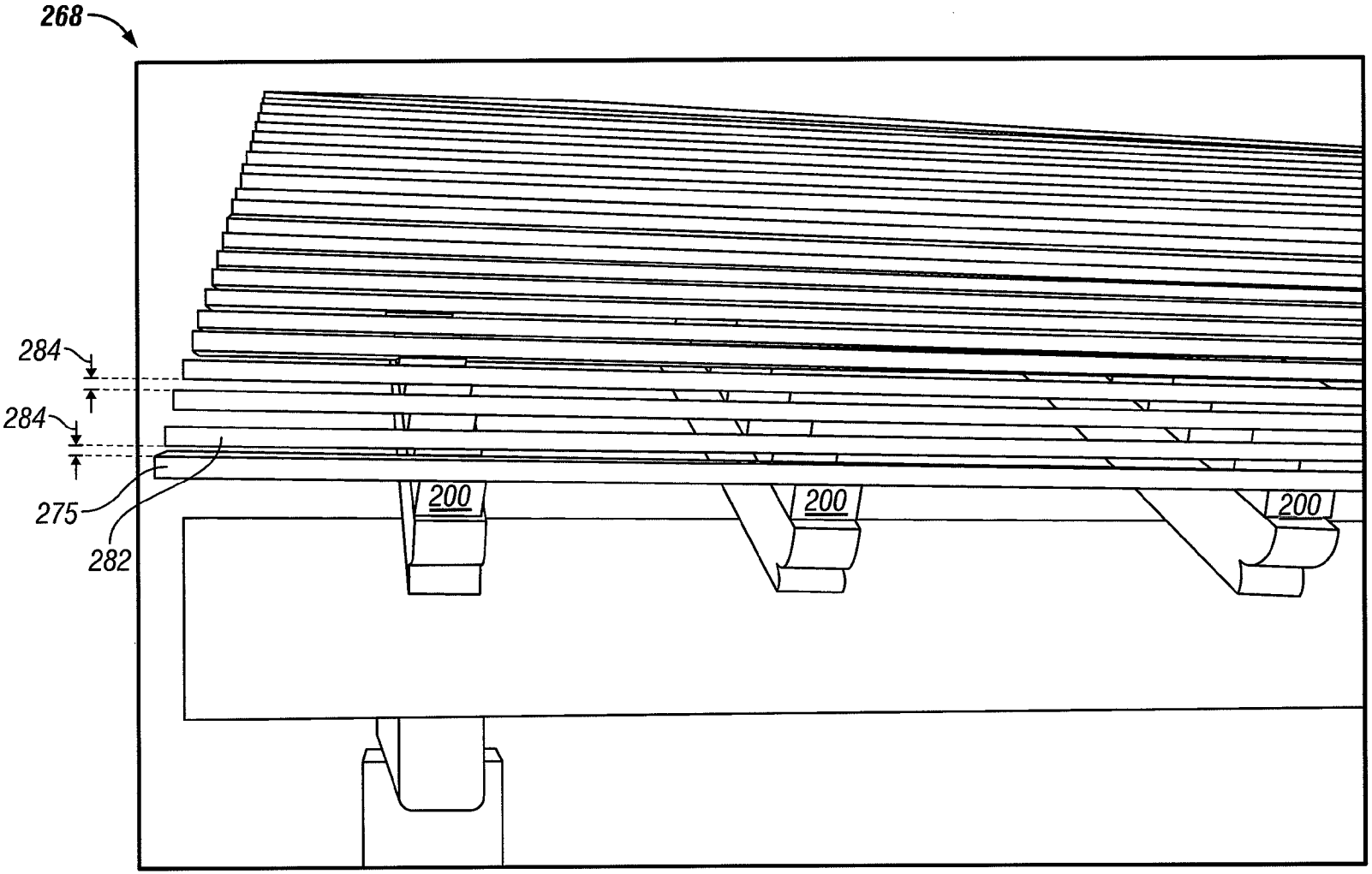

FIG. 6 illustrates the vertical spaces 284 that can be provided between adjacent panels 275, 282 according to some embodiments of the present invention. As described above with reference to FIGS. 3 and 4, the vertical spaces 284 between adjacent panels of the roof 268 can allow air and light to enter through the roof 268, while also preventing weather elements such as rain from entering the space below the roof 268.

Figure 7:
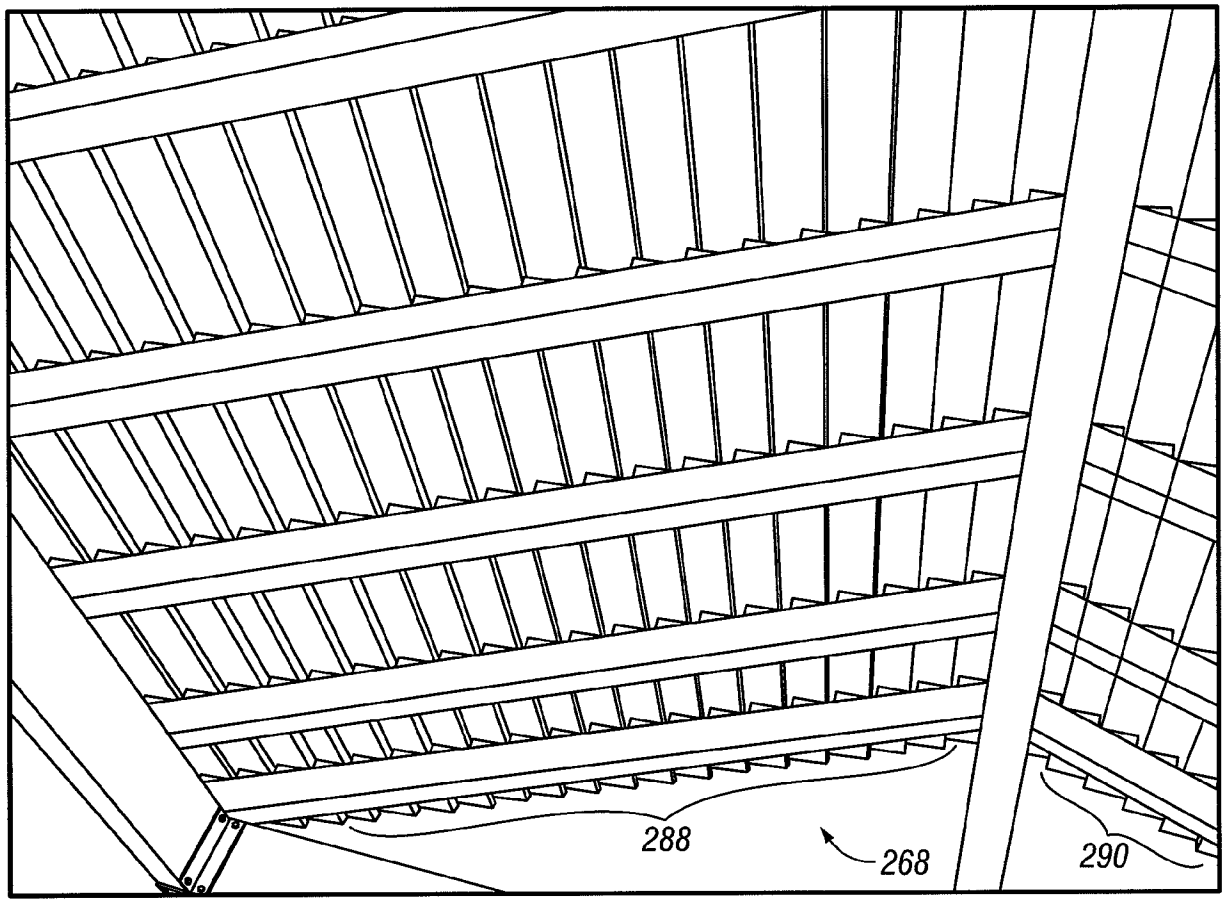

FIG. 7 illustrates a plurality of spacers 200 in use on the roof 268. A spacer is provided at the interface between each panel and each supporting beam. As described above with reference to FIG. 3, the top surface of a first panel and the bottom surface of a second, higher panel are horizontally overlapped such that rain and other weather elements falling in a vertical direction do not enter the vertical spaces 284 and penetrate the space below the roof 268.

Embodiments of the spacers 200 can advantageously be used to construct two-sided roofing structures. For example, the roof 268 illustrated in FIGS. 2-9 comprises a first side 288 and a second side 290. The spacers 200 are positioned between support beams and panels on the first side 288, as well as between support beams and panels on the second side 290.

Figure 9B:
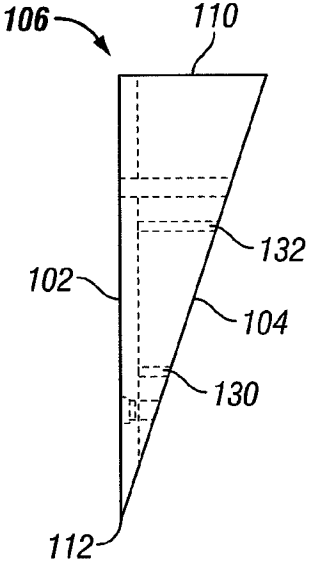
FIG. 9B is a side elevational view of the device of FIG. 1A showing additional internal features.
Figure 9A:
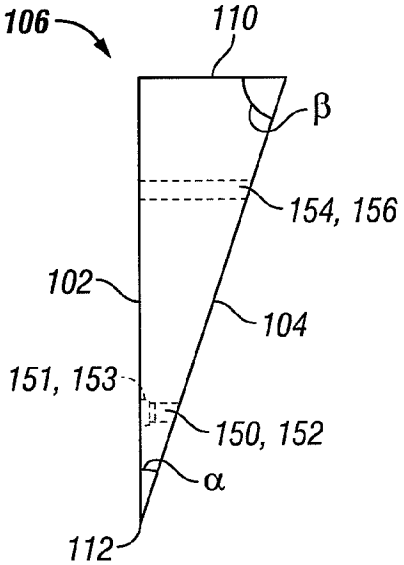
FIG. 9A is a side elevational view of the device of FIG. 1A.
Figure 10B:
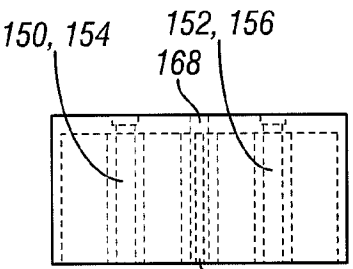
FIG. 10B is a back elevational view of the device of FIG. 1A showing additional internal features.
Figure 8:
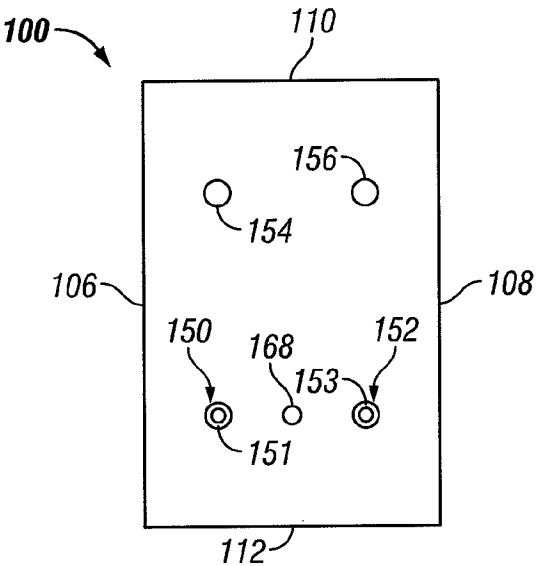
FIG. 8 is a top elevational view of the device of FIG. 1A.
Figure 10A:
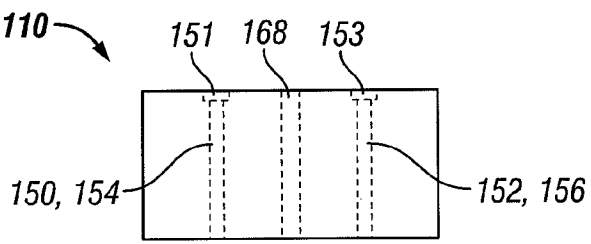
FIG. 10A is a back elevational view of the device of FIG. 1A.

FIG. 8 is a top elevational view of the spacer 100. FIG. 9A is an elevational view of the side 106 of the spacer 100, illustrating internal features in dashed lines. FIG. 9B is an elevational view of the side 106 showing additional internal features such as the width ribs 130, 132. FIG. 10A is an elevational view of the back 110 of the spacer 100, illustrating internal features in dashed lines. FIG. 10B is an elevational view of the back 110 illustrating additional internal features, including ribs and nail box features.

As described above with reference to FIGS. 1A-1C, the spacer 100 can include nail boxes 150, 152, 154, 156, and 168. In one embodiment, the nail box 150 comprises a recessed area 151 and the nail box 152 comprises a recessed area 153. The recessed areas 151, 153 can accommodate the head of a nail or other fastener disposed in nail boxes 150, 152, respectively. It will be understood that other nail boxes of the spacer 100 can comprise recessed areas, and that the spacer 100 need not comprise any recessed areas around the nail boxes.

Referring now to FIG. 9A, the bottom surface 104 of the spacer 100 may be inclined at an angle $\alpha$ relative to the top surface 102. The angle $\alpha$ can be between about 10° and about 25°. In one embodiment, the angle $\alpha$ corresponds to the angle $\theta_{BEAM}$ of the support beams of the roof relative to a horizontal axis x of the roof. Where $\alpha$ equals $\theta_{BEAM}$, the top surface 276 of the panels of the roof may lie substantially horizontally on the spacers, such that the angle $\theta_{PANEL}$ of the panels relative to the horizontal axis x of the roof is 0° or about 0°.

Additionally, the bottom surface 104 can be inclined at an angle $\beta$ relative to the back 110. The angle $\beta$ can be between about 80° and about 65°. In the embodiment illustrated in FIG. 9A, angle $\alpha$ is about 18° and the angle $\beta$ is about 72°. Other configurations are possible. For example, for a roof comprising support beams disposed at an angle $\theta_{BEAM}$ of 20°, the spacer 100 can be modified such that the angle $\alpha$ is 20° and the angle $\beta$ is 70°.

FIGS. 10A and 10B show additional views of the spacer 100. FIG. 10A illustrates nail boxes 150, 152, 154, 156, 168, as well as recessed areas 151, 153 in dashed lines. FIG. 10B illustrates rib 134 in dashed lines.

FIG. 1A illustrates advantageous dimensions of certain specific embodiments of the spacer 100. For example, the top surface of the spacer 100 is about 6 inches by about 4 inches; and the back 110 is about 4 inches by about 2 inches. Persons of skill in the art will understand that other dimensions are possible, and embodiments of the spacer 100 are not limited to the number or configuration of nail boxes shown, or the dimensions of spacer 100.

Roof Panel Spacer for Roof with Three or More Sides

Figure 11B:
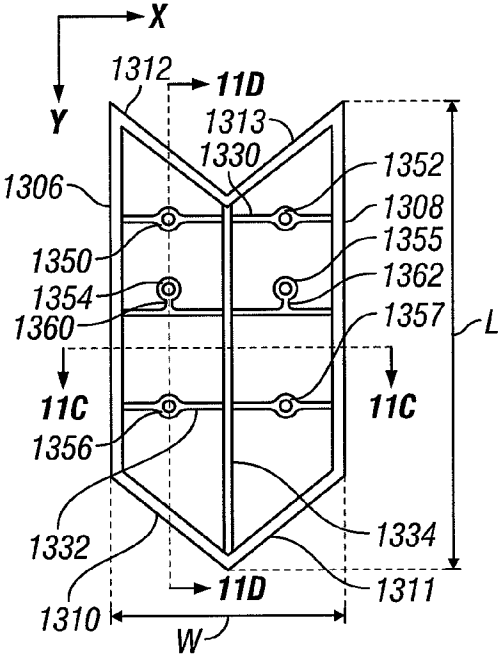
FIG. 11B is a bottom elevational view of the device of FIG. 11A.
Figure 11C:
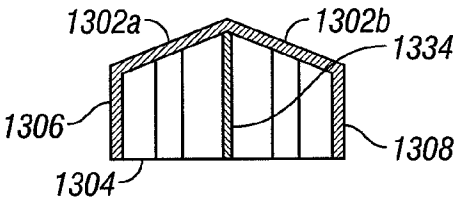
FIG. 11C is a cross-sectional view of the device of FIG. 11A taken along line 11C-11C of FIG. 11B.
Figure 11D:
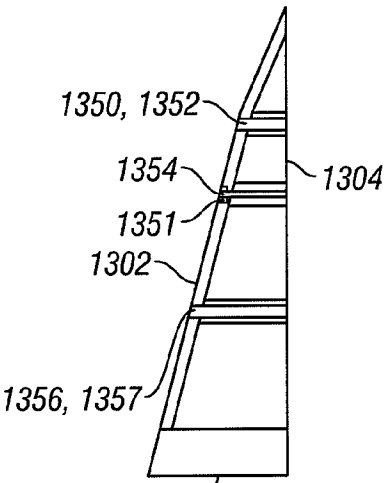
FIG. 11D is a cross sectional view of the device of FIG. 11A taken along line 11D-11D of FIG. 11B.
Figure 11A:
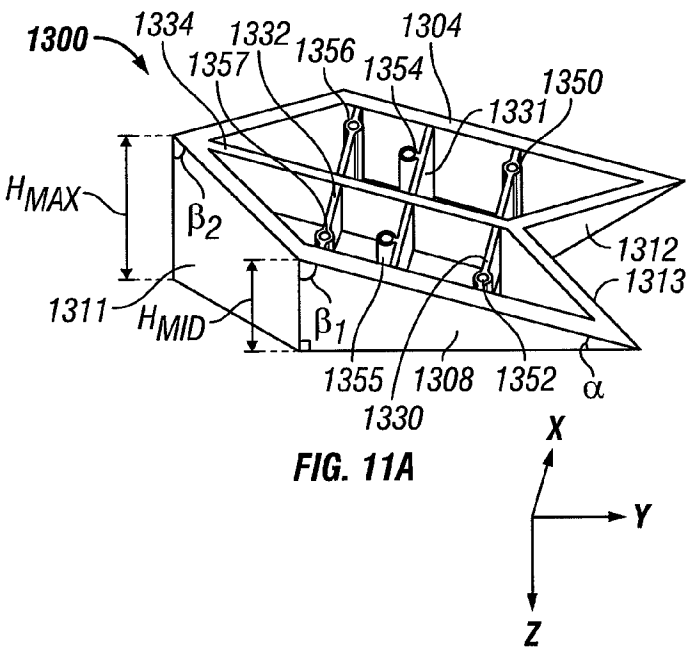
FIG. 11A is a bottom perspective view of another embodiment of a roof panel spacer device.

FIG. 11A is a bottom perspective view of an embodiment of a roof panel spacer 1300 according to the present invention. FIG. 11B is a bottom elevational view of the spacer 1300. FIG. 11C is a cross-sectional view taken along line 11C-11C of FIG. 11B. FIG. 11D is a cross-sectional view taken along line 11D-11D of FIG. 11B. Embodiments of the spacer 1300 can be used to construct roofing structures with three or more sides.

The spacer 1300 generally has a width W measured along an x-axis of the spacer 1300, a length L measured along a y-axis of the spacer 1300, and a height H measured along a z-axis of the spacer 1300. The spacer 1300 includes a first top surface 1302A; a second top surface 1302B; a bottom surface 1304; and sides 1306, 1308, 1310, 1311, 1312, and 1313. In some aspects, the spacer 1300 includes a peaked top surface.

The height H of the spacer 1300 can be measured at different locations along the spacer 1300. For example, the height of the spacer 1300 where the sides 1310, 1311 meet can be $H_{MAX}$, while the height of the spacer 1300 where the sides 1308, 1311 meet can be $H_{MID}$. Embodiments of the spacer 1300 can be wedge-shaped. For example, the top surface 1302 of the spacer 1300 may be inclined at an angle $\alpha$ relative to the bottom surface 1304. The bottom surface 1304 can also be inclined by an angle $\beta_1$ relative to the intersection of the sides 1308, 1311. Additionally, the bottom surface 1304 can be inclined at an angle $\beta_2$ relative to the intersection of the sides 1310, 1311.

The spacer 1300 can include an integral support structure connecting the top surface 1302 and the bottom surface 1304. The support structure can include a plurality of support ribs. For example, the spacer 1300 includes width ribs 1330, 1332 extending along the width W of the spacer 1300 between the sides 1306, 1308. The spacer 100 can also comprise a length rib 1334 extending along the length L of the spacer 1300 between the sides 1310, 1311 and the sides 1312, 1313. Bottom surfaces of the ribs 1330, 1332, 1334 can form a portion of the bottom surface 1304 of the spacer 1300.

In some aspects, the support structure includes a plurality of nail boxes. For example, the spacer 1300 comprises nail boxes 1350, 1352, 1354, 1355, 1356, and 1357. Some embodiments of the nail boxes 1350, 1352, 1354, 1355, 1356, and 1356 comprise a hollow tube extending from the top surface 1302 and the bottom surface 1304. The nail boxes 1354, 1355 can be connected to the width rib 1331 via flanges 1360 and 1362. Other configurations are possible. For example, in some aspects, the spacer 1300 may not comprise width ribs, length ribs, nail boxes, and/or flanges.

In some aspects, the nail box 1354 comprises a recessed area 1351 and the nail box 1355 comprises a recessed area 1353 (not illustrated). The recessed areas 1351, 1353 can accommodate the head of a nail or other fastener disposed in nail boxes 1354, 1355, respectively. It will be understood that other nail boxes of the spacer 1300 can comprise recessed areas, and that the spacer 1300 need not comprise any recessed areas around the nail boxes.

Figure 12:
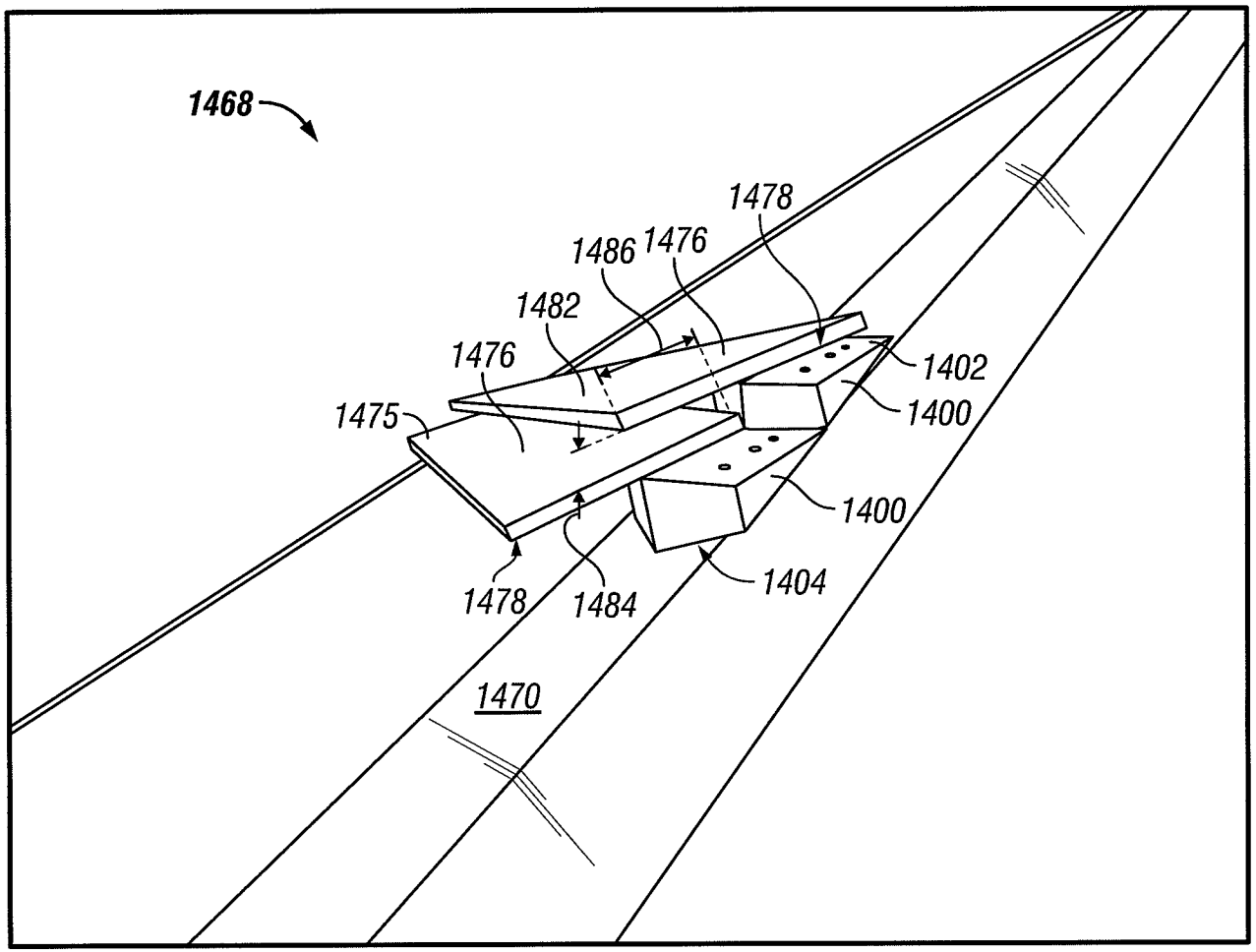
FIGS. 12-15 illustrate the device of FIG. 11A in use on a roof.

FIGS. 12-15 illustrate this embodiment of a spacer according to the present invention in use on a roof 1468 that has three or more sides. Referring now to FIG. 12, a spacer 1400 according to one embodiment is positioned between a support beam 1470 and a first roofing panel or board 1475. The roof 1468 also comprises a second spacer 1400 positioned between the support beam 1470 and a second panel 1482. The support beam 1470 includes a top surface 1472. The panels 1475, 1482 each include a top surface 1476 and a bottom surface 1478. The support beam 1470 can comprise a portion of the support structure of a roofing system, and the panels 1475, 1482 can comprise a portion of the outer skin of the roofing system.

A top surface 1402 of the spacers 1400 are adjacent to and contact the bottom surfaces 1478 of the panels 1475, 1482, while a bottom surface 1404 of the spacers 1400 are adjacent to and contact the top surface 1472 of the support beam 1470. Other configurations are possible.

In one embodiment of the present invention, the spacers 1400 are positioned on the support beam 1470 such that a vertical space 1484 separates the panels 1475, 1482. In some aspects, each of the adjacent panels on the roof 1468 are separated by a vertical space 1484. As described above with reference to FIG. 3, the vertical spaces 1484 can advantageously allow for air to enter the space underneath the roof 1468 and circulate within the space. Advantageously, the vertical spaces 1484 can also allow light to enter the space underneath the roof 1468.

In some aspects, the top surface 1476 of the panel 1475 and the bottom surface 1478 of the panel 1482 overlap in a region 1486. This overlap between adjacent panels 1475, 1482 can advantageously restrict rain and other weather elements from passing through the spaces 1484 and entering the space underneath the roof 1468.

Figure 13:
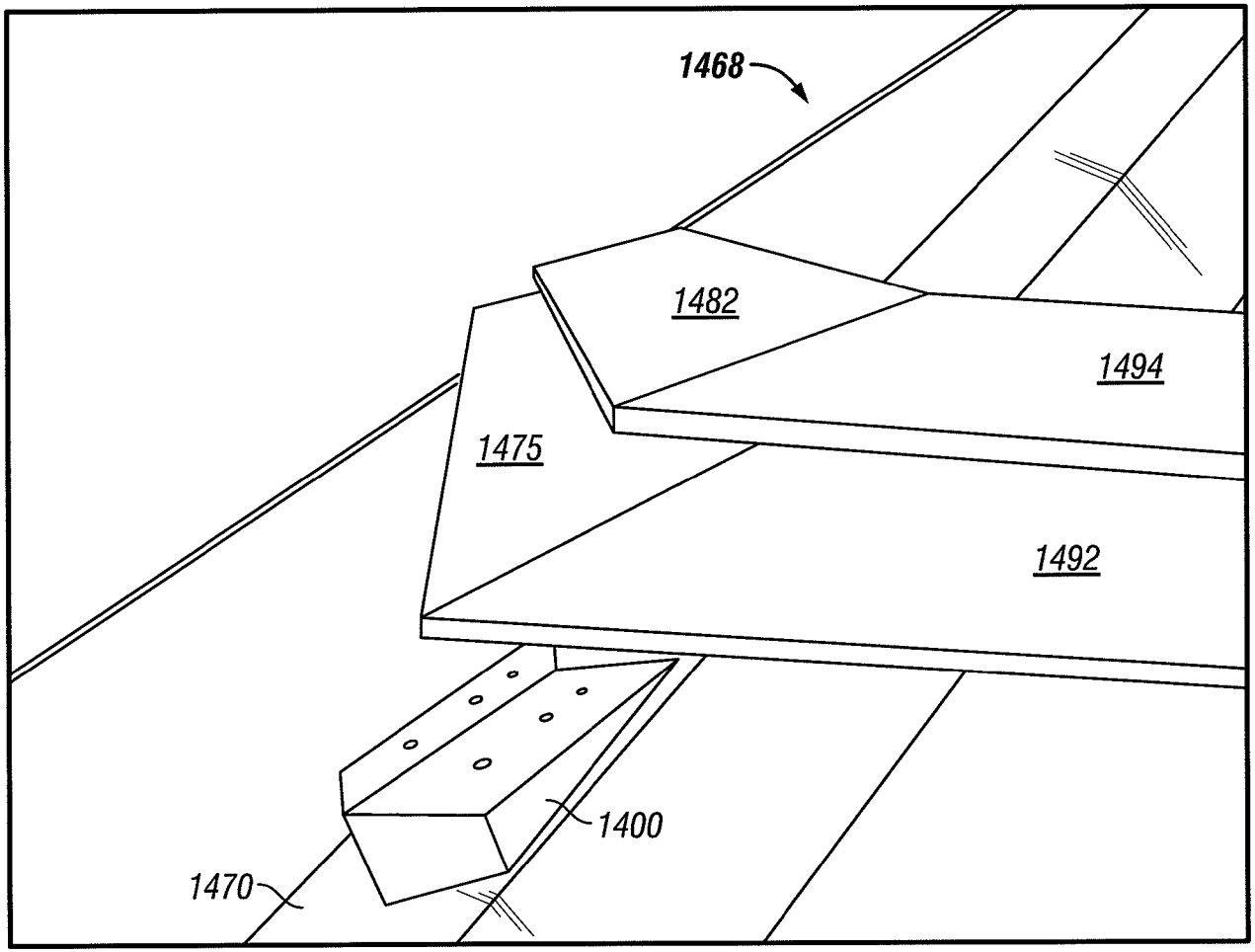
Figure 14:
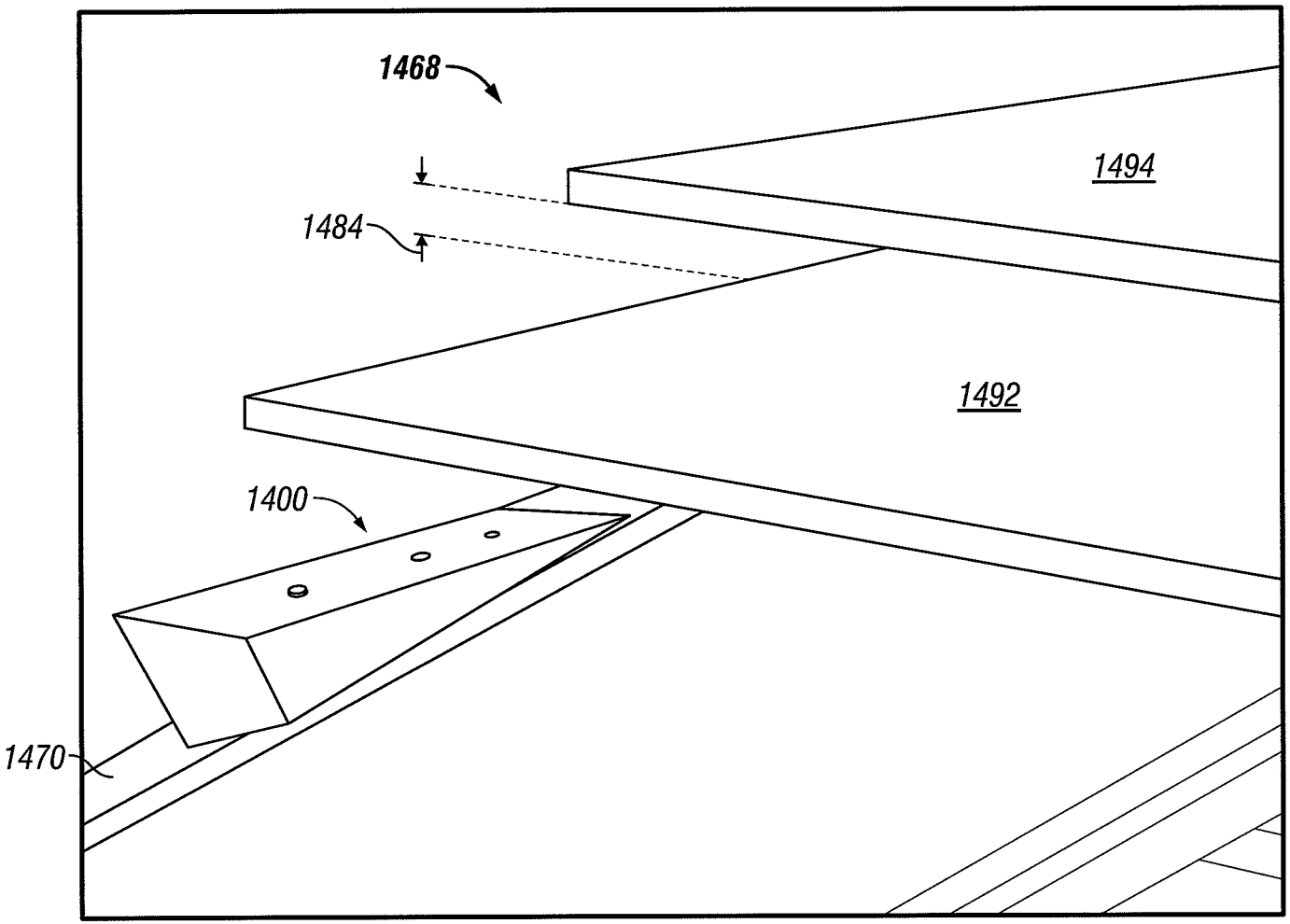
Figure 15:
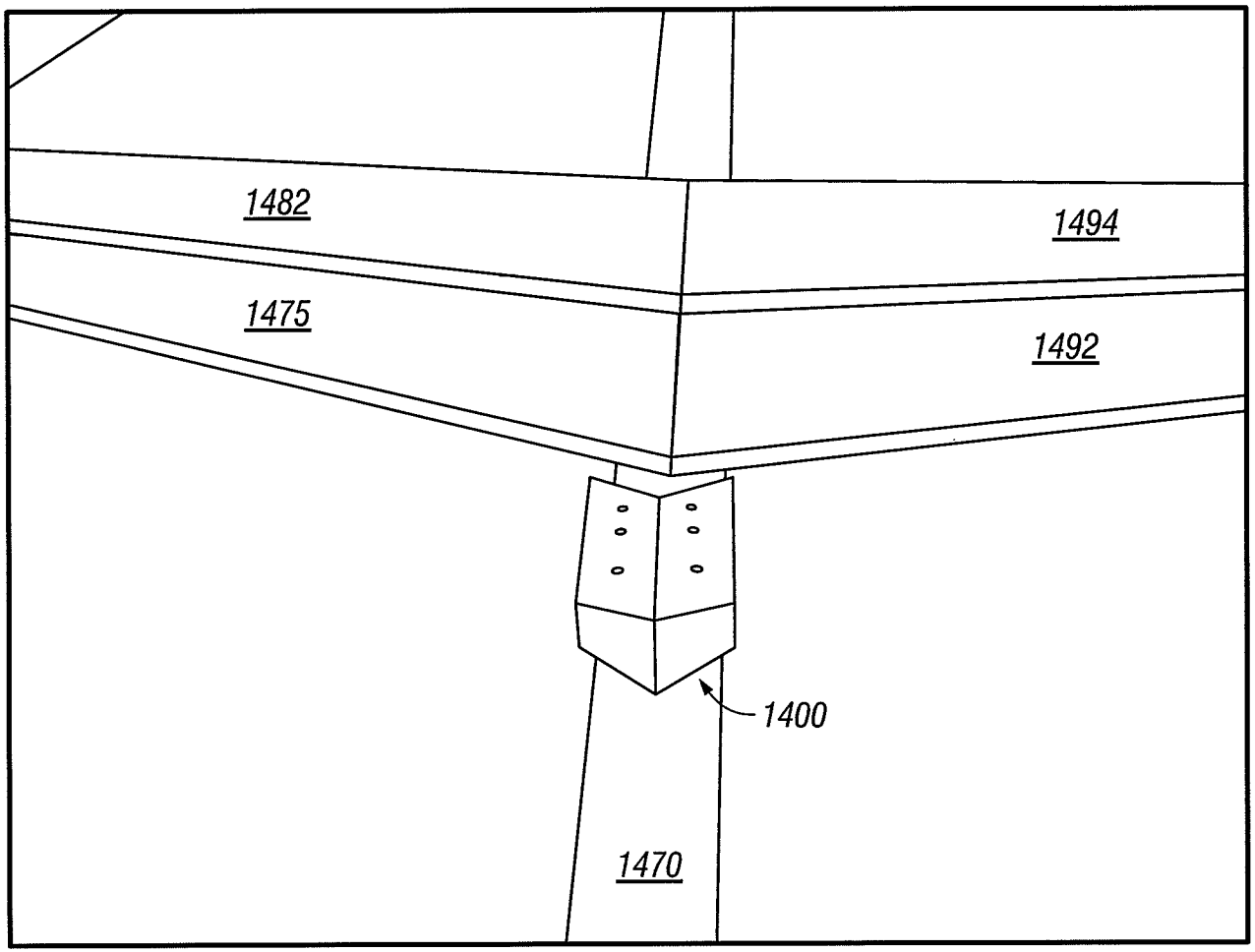

FIGS. 13-15 illustrate a plurality of panels spaced from the support beam 1470 by the spacers 1400. The panel 1475 and a panel 1492 are positioned on a first spacer 1400 (not illustrated), and the panel 1482 and a panel 1494 are positioned on a second spacer 1400 (not illustrated). A third spacer 1400 is also positioned on the support beam 1470, ready to receive panels. As described above, the spacers 1400 allow the panels 1492, 1494 to be advantageously separated by a vertical space 1484.

Installation of Roofing Spacers

Embodiments of the roofing spacers described herein can be installed using fasteners such as nails. In one embodiment, a spacer according to the present invention is first positioned on a support beam. Nails are driven into one or more nail boxes of the spacer. The nails may be driven into nail boxes comprising recessed areas, for example. These nails may initially restrict movement of the spacer relative to the support beam until additional nails are driven into the spacer. Next, a panel is positioned over the spacer, and additional nails are driven through the panel into the spacer. In some aspects, the installer is aware of the general location of the nail boxes which remain empty, but is not able to see the precise location of the empty nail boxes through the panel. The installer can estimate the location of the empty nail boxes and aim the nails so that they enter the spacer at or near the empty nail boxes.

It will be understood by those of skill in the art that positioning nails precisely in the nail boxes is not required to install embodiments of spacers described herein. Nails and other fasteners can effectively secure the spacers to support beams, and panels to the spacers, if they are driven into the nail boxes, the ribs, and/or the flanges described herein. It will also be understood that a nail need not be driven into each nail box provided on the spacers in order to secure the spacer to a support beam, or to secure a panel to the spacer.

Materials for a Roofing Spacer

Embodiments of the spacers described herein can be made of any suitable material, including plastic or metal. In one embodiment, spacers according to the present invention are made of polypropylene copolymer. In some aspects, the comonomer of the polypropylene copolymer is ethylene. Polypropylene copolymer is characterized as having high impact resistance strength. Polypropylene copolymer also has slightly increased elongation at break, and is thus more pliable, compared to unmodified polypropylene homopolymer. Typical material properties of polypropylene copolymer are provided in Table 1 below.

TABLE 1

| Property | |
|---|---|
| Yield Point | 24 MPa |
| Elongation at Yield | 10-12% |

TABLE 1-continued

| Property | |
|---|---|
| Tensile Break | 33 MPa |
| Elongation at Break | 650% |
| Tensile Modulus | 1050 MPa |
| Flexural Modulus | 1270 MPa |
| Flexural Strength | 25-26 MPa |
| Tensile Impact | 800 kJ/m2 |

Spacers described herein need not be made of polypropylene copolymer, and can be made of any suitable material, including but not limited to materials exhibiting material properties similar to that of polypropylene copolymer. Spacers made of polypropylene copolymer can advantageously accept fasteners without shattering or suffering other adverse structural effects which may result when a nail or other fastener is driven into the spacer.

Embodiments of the spacers described herein can be molded from one piece of injection-molded plastic, such that the spacer is monolithic. The spacers described herein can also be manufactured by connecting together separate components, such as the top surface, the bottom surface, the back, and the integral support structure, to form one spacer.

The above-described embodiments have been provided by way of example, and the present invention is not limited to these examples. Multiple variations and modifications to the disclosed embodiments will occur, to the extent not mutually exclusive, to those skilled in the art upon consideration of the foregoing description. Additionally, other combinations, omissions, substitutions and modifications will be apparent to the skilled artisan in view of the disclosure herein. Accordingly, the present invention is not intended to be limited by the disclosed embodiments.

What is claimed is:

1. A roof panel spacer system for constructing a roof, the system comprising:

a plurality of angled support beams, the plurality of angled support beams comprising a first support beam adjacent to a second support beam;

a plurality of spacers fastened to at least some of said angled support beams;

a plurality of roof panels fastened to the plurality of spacers, the plurality of roof panels comprising a first roof panel adjacent to a second roof panel, the first roof panel fastened to a first spacer and a second spacer located on the first support beam and the second support beam, respectively, the second roof panel fastened to a third spacer and a fourth spacer located on the first support beam and the second support beam, respectively;

wherein each spacer orients each roof panel substantially horizontal to the ground;

wherein each spacer is positioned to create a space between adjacent roof panels, allowing air and light to pass through the roof; and wherein each spacer is positioned to create an overlap between adjacent roof panels, inhibiting rain and other weather elements from passing through the roof.

2. The system of claim 1, wherein each of the plurality of roof panels is fastened to a plurality of spacers located on adjacent support beams.

3. The system of claim 1, wherein at least one of the plurality of spacers is a wedge-shaped spacer.

4. The system of claim 1, wherein the first spacer and the second spacer are fastened to a top surface of the first support beam and the second support beam, respectively.

5. The system of claim 1, wherein the first roof panel is fastened to a top surface of the first spacer and the second roof panel is fastened to a top surface of the third spacer such that air and light can pass through the spacer system between the first roof panel and the second roof panel.

6. The system of claim 1, wherein the second spacer and the fourth spacer are fastened to a top surface of the second support beam.

7. The system of claim 1, wherein the first spacer and the second spacer orient the first roof panel substantially horizontal to the ground.

8. The system of claim 1, wherein the third spacer and the fourth spacer orient the second roof panel substantially horizontal to the ground.

9. The system of claim 1, wherein a vertical space between the first roof panel and the second roof panel allows air and light to pass through the spacer system between the first roof panel and the second roof panel.

10. The system of claim 1, wherein a bottom surface of the second roof panel overlaps with a top surface of the first roof panel.

11. The system of claim 1, wherein each spacer has a length axis generally extending between a back and a front of the spacer, and wherein the spacers are fastened to a top surface of a corresponding support beam such that the length axis of each spacer is generally parallel to a longitudinal axis of the support beam to which it is fastened.

12. The system of claim 1, wherein at least one spacer comprises:

a bottom surface; and a top surface inclined at an angle $\alpha$ relative to the bottom surface.

13. The system of claim 12, wherein the angle $\alpha$ is between approximately 10° and approximately 25°.

14. The system of claim 12, wherein the angle $\alpha$ is the same or substantially the same as an angle $\theta$ relative to horizontal of at least one support beam to which the spacer is fastened.

15. The system of claim 12, wherein an integral support structure connects the top surface and the bottom surface, the support structure comprising a plurality of support ribs and a plurality of nail boxes, and wherein at least one nail box comprises a hollow tube extending from the top surface to the bottom surface of the spacer.

16. The system of claim 15, wherein at least one nail box is connected to one of the plurality of support ribs by a flange.

17. The system of claim 12, wherein the at least one spacer comprises a polymer or a polypropylene copolymer.

18. A roof panel spacer system for constructing a roof, the system comprising:

a plurality of support beams;

a plurality of wedge-shaped spacers fastened to at least some of said support beams, at least one wedge-shaped spacer comprising a bottom surface and a top surface inclined at an angle $\alpha$ relative to the bottom surface;

a plurality of roof panels fastened to the plurality of spacers, wherein each spacer orients each roof panel substantially horizontal to the ground;

wherein each spacer is positioned to create a space between adjacent roof panels, allowing air and light to pass through the roof, and wherein each spacer is positioned to create an overlap between adjacent roof panels, inhibiting rain and other weather elements from passing through the roof.

19. The system of claim 18, comprising a first roof panel adjacent to a second roof panel, the first roof panel fastened to a pair of spacers located on two adjacent support beams, the second roof panel fastened to a different pair of spacers located on the same two adjacent support beams.

20. The system of claim 18, wherein the at least one wedge-shaped spacer at least partially compensates for the angle of the support beam to which it is fastened.

* * * * *